US007717360B1

(12) United States Patent
Kander

(10) Patent No.: US 7,717,360 B1
(45) Date of Patent: May 18, 2010

(54) IN GROUND SPRINKLER HEAD ENCAPSULATED PROTECTION APPARATUS

(76) Inventor: Keith S. Kander, 10906 NW. 62nd Ct., Parkland, FL (US) 33076

( * ) Notice: Subject to any disclaimer, the term of this patent is extended or adjusted under 35 U.S.C. 154(b) by 320 days.

(21) Appl. No.: 11/686,343

(22) Filed: Mar. 14, 2007

(51) Int. Cl.
*B05B 3/00* (2006.01)
*B05B 15/06* (2006.01)
*B05B 15/10* (2006.01)
*B05B 15/04* (2006.01)
*B05B 1/00* (2006.01)

(52) U.S. Cl. ..... 239/208; 239/288.5; 239/201; 239/285; 239/600; 239/204

(58) Field of Classification Search ..... 239/208, 239/288.5, 203, 204, 205, 206, 288, 288.3, 239/201, 207, 200, 600, 289, 202, 285
See application file for complete search history.

(56) References Cited

U.S. PATENT DOCUMENTS 1,837,322 A * 12/1931 Hamilton ..... 239/201
1,970,126 A * 8/1934 Buckner ..... 239/206
2,751,250 A * 6/1956 Block ..... 239/201
2,756,099 A 7/1956 Reynolds Jr.
3,015,448 A * 1/1962 Hurless ..... 239/201
3,018,057 A 1/1962 Anderson
3,021,078 A 2/1962 Nickell
3,117,724 A 1/1964 Ray
3,193,205 A * 7/1965 Hanson ..... 239/276
3,265,310 A * 8/1966 Cohen ..... 239/201
3,266,730 A 8/1966 Martini
3,317,144 A * 5/1967 Muschett ..... 239/204
3,408,006 A * 10/1968 Stanwood ..... 239/66
3,650,478 A 3/1972 Jones
3,655,132 A 4/1972 Rosie
3,662,956 A * 5/1972 Hedman ..... 239/201
3,762,642 A 10/1973 DiSanto
3,830,434 A * 8/1974 Green et al. ..... 239/562
3,874,588 A 4/1975 Flynn
3,904,120 A * 9/1975 Sbicca ..... 239/201
3,934,820 A 1/1976 Phaup
4,003,520 A * 1/1977 Bailey ..... 239/205
4,095,744 A 6/1978 Villelli
D251,064 S * 2/1979 Bergland ..... D23/218
4,146,181 A * 3/1979 Soos ..... 239/288.5
4,212,426 A 7/1980 Choi
D256,386 S 8/1980 Bergland
4,350,296 A * 9/1982 Kuhlman et al. ..... 239/201
4,429,832 A * 2/1984 Sheets ..... 239/204
4,582,256 A * 4/1986 Jaquez ..... 239/288.5

(Continued)

*Primary Examiner*—Dinh Q Nguyen
*Assistant Examiner*—Steven Cernoch
(74) *Attorney, Agent, or Firm*—Allen D. Hertz

(57) ABSTRACT

An in-ground sprinkler serviceability apparatus that provides a debris free environment for ease of replacement of an in-ground sprinkler head. The sprinkler serviceability apparatus couples to the threads of a sprinkler pipe, expands to provide a sprinkler head receiving section, a seal against the underside of the sprinkler head, and a tapered upper surface. Any debris would be washed away from the sprinkler head serviceability apparatus tapered upper surface when the sprinklers are on, rain, etc. The seal would ensure against any debris falling into the sprinkler head receiving section. Weep holes can optionally be incorporated into the sides or base of the apparatus. The top can be a single section, fabricated in two sections, or be designed to receive a common clay sprinkler donut.

20 Claims, 8 Drawing Sheets

U.S. PATENT DOCUMENTS 4,781,327 A 11/1988 Lawson et al.
5,037,030 A 8/1991 Apodaca
5,039,015 A 8/1991 DeLaVega, Jr.
D333,507 S 2/1993 Colo'n
5,211,338 A 5/1993 Leite et al.
5,213,262 A * 5/1993 Violette ..... 239/203
5,253,952 A * 10/1993 Selway ..... 404/25
D347,259 S 5/1994 Fewell et al.
5,458,290 A * 10/1995 Johnson ..... 239/203
5,918,814 A 7/1999 Hough
5,931,385 A 8/1999 Miller
5,938,121 A * 8/1999 Ferguson et al. ..... 239/203
6,047,897 A 4/2000 Ueno et al.
6,138,924 A 10/2000 Hunter et al.
6,186,416 B1 2/2001 Jones
6,209,803 B1 4/2001 Colo'n
D457,942 S 5/2002 Bouras
6,398,131 B1 6/2002 Kirk
6,439,476 B1 * 8/2002 Boggs ..... 239/203
6,488,218 B1 * 12/2002 Townsend et al. ..... 239/205
6,494,386 B1 * 12/2002 Banu ..... 239/288
6,543,704 B2 * 4/2003 Stephens ..... 239/201
6,764,025 B1 * 7/2004 Espina ..... 239/288
2001/0032890 A1 * 10/2001 Stephens ..... 239/288.5

* cited by examiner

IN GROUND SPRINKLER HEAD ENCAPSULATED PROTECTION APPARATUS

FIELD OF THE INVENTION

The invention relates to an apparatus and method using an in-ground sprinkler serviceability enhancing apparatus wherein said serviceability enhancing apparatus ensures against encroachment of debris about the sprinkler head, both during operation of the sprinkler head as well as replacement of the sprinkler head.

BACKGROUND OF THE INVENTION

In-ground sprinkler heads are common for both residential and commercial landscapes. The functionality of the sprinkler heads can be inhibited by debris growing or gathering about the top of the sprinkler head. The serviceability can be inhibited by dirt, growth, and debris encroaching into the cavity where the sprinkler head resides. The dirt and debris surrounding a sprinkler head cavity makes it difficult to remove, replace, and service a sprinkler head. Additionally, growth and debris can cover the sprinkler head further inhibiting functionality and serviceability of the sprinkler head.

Several devices have been invented to maintain a sprinkler head free from growth and debris across the top of a sprinkler head.

Fabiano (U.S. Pat. No. 5,772,118) teaches an in-ground sprinkler head guard which encompasses a sprinkler head. Fabiano focuses on a solution to avoid growth and debris from covering the top of the sprinkler head. Fabiano is limited in that the top shape allows dirt to collect in the upper section, wherein when one removes the sprinkler head, the dirt would fall into the lower section cavity 18. The design allows dirt to fall into the cavity section and into the sprinkler piping.

Violette (U.S. Pat. No. 5,213,262) teaches an in-ground sprinkler head guard that encompasses a sprinkler head and is designed to distribute a heavy load away from the sprinkler head. Violette teaches a flat top plate to distribute any applied load between an outer wall and an inner wall of the sprinkler head guard. The requirement of an inner and outer wall of the base section requires a separate cover section for manufacturability. The snap feature between the base and the cover sections dictates a fixed height of the guard.

Nickell (U.S. Pat. No. 3,021,078) teaches a sprinkler protection that surrounds the sprinkler head. The protection system is coupled to the sprinkler head. This is typical in a number of issued Patents.

Hanson (U.S. Pat. No. 3,193,205) teaches a sprinkler support system for supporting a sprinkler head. FIGS. 4 and 5 include an expansion about the base of the sprinkler head for keeping grass out. The required slot 17 would allow dirt and other debris into the sprinkler connector 13 and head 14 area.

Several other patents teach a sprinkler head protection apparatus, including Jaquez (U.S. Pat. No. 4,582,256), Apodaca (U.S. Pat. No. 5,037,030), and Leite, et al. (U.S. Pat. No. 5,211,338). Each of these teachings provide an apparatus which is to distribute a load proximate a sprinkler head as a device that protects the sprinkler head against damage from the applied load.

What is desired is a means for protecting a sprinkler head, ensuring against encroachment of growth and debris over a sprinkler head, and ensuring growth and debris does not contaminate piping or interfere with a cavity for a sprinkler head.

SUMMARY OF THE PRESENT INVENTION

A first aspect of the present invention is a sprinkler head serviceability apparatus that creates and maintains a receiving cavity for an in-ground sprinkler head.

Yet another aspect of the present invention is wherein said receiving cavity is fabricated via a single wall.

Yet another aspect of the present invention is a sprinkler head serviceability apparatus that seals against the underside of a sprinkler head.

Yet another aspect of the present invention is a sprinkler head serviceability apparatus that seals against the underside of a sprinkler head, wherein said seal is of a flexible material.

Yet another aspect of the present invention is a sprinkler head serviceability apparatus that seals against the underside of a sprinkler head, wherein said seal is of a flexible material such as an O-ring.

Yet another aspect of the present invention is a sprinkler head serviceability apparatus that seals against the underside of a sprinkler head, wherein said seal is of a flexible material such as a rubber or nylon O-ring.

Yet another aspect of the present invention is a sprinkler head serviceability apparatus that seals against the underside of a sprinkler head, wherein said seal is a separate component and inserts into a body of said sprinkler head serviceability apparatus.

Yet another aspect of the present invention is a sprinkler head serviceability apparatus comprising a downward sloping debris clearance ring about said sprinkler head.

Yet another aspect of the present invention is a sprinkler head serviceability apparatus comprising a downward sloping debris clearance ring about said sprinkler head and away from said receiving cavity.

Yet another aspect of the present invention is a sprinkler head serviceability apparatus comprising a sprinkler head seal that contacts the underside of a sprinkler head and a debris clearance ring sloping downward as it extends from said seal located about said sprinkler head.

Yet another aspect of the present invention is a sprinkler head serviceability apparatus comprising a coupling feature which couples said sprinkler head serviceability apparatus to a sprinkler head pipe.

Yet another aspect of the present invention is a sprinkler head serviceability apparatus comprising a coupling feature which couples said sprinkler head serviceability apparatus to a sprinkler head pipe at the base of said cavity section.

Yet another aspect of the present invention is a sprinkler head serviceability apparatus comprising a coupling feature which couples said sprinkler head serviceability apparatus to a sprinkler head pipe via a threaded section.

Yet another aspect of the present invention is a sprinkler head serviceability apparatus comprising a coupling feature which couples said sprinkler head serviceability apparatus to a sprinkler head pipe via a partially threaded piping sleeve section.

Yet another aspect of the present invention is a sprinkler head serviceability apparatus comprising a coupling feature which couples said sprinkler head serviceability apparatus to a sprinkler head pipe via a partially threaded piping sleeve section and a bored out section.

Yet another aspect of the present invention is a sprinkler head serviceability apparatus comprising a donut-holding member for holding a common clay donut about said sprinkler head for additional protection of said sprinkler head.

Yet another aspect of the present invention is a sprinkler head serviceability apparatus comprising a donut holding member for holding a common clay donut about said sprinkler head for additional protection of said sprinkler head, said donut holding member further comprising a section sloping downward away from said sprinkler head for removal of debris from said sprinkler head.

Yet another aspect of the present invention is a sprinkler head serviceability apparatus comprising an adjustable section for adjusting the overall height of said sprinkler head serviceability apparatus.

Yet another aspect of the present invention is a sprinkler head serviceability apparatus comprising a bottom section.

Yet another aspect of the present invention is a sprinkler head serviceability apparatus comprising a bottom section, wherein said bottom section further comprising at least one drainage aperture.

Yet another aspect of the present invention is a sprinkler head serviceability apparatus comprising an upper and a lower section, wherein said upper section is adjustably coupled to said lower section providing an adjustable height.

Yet another aspect of the present invention is a sprinkler head serviceability apparatus comprising an upper and a lower section, wherein said upper section is adjustably coupled to said lower section providing an adjustable height and further enhancing manufacturability for the seal section proximate the opening for said sprinkler head.

Yet another aspect of the present invention is a sprinkler head serviceability apparatus comprising an upper and a lower section, wherein said upper section is adjustably coupled to said lower section providing an adjustable height, wherein said adjustability is accomplished via a threaded section.

Yet another aspect of the present invention is a sprinkler head serviceability apparatus comprising an upper and a lower section, wherein said upper section is adjustably coupled to said lower section providing an adjustable height, wherein said adjustability is accomplished via a snap section.

Yet another aspect of the present invention is a sprinkler head serviceability apparatus comprising an upper and a lower section, wherein said upper section resembles a common sprinkler donut.

Yet another aspect of the present invention is a sprinkler head serviceability apparatus comprising an upper and a lower section, wherein said upper section resembles a common sprinkler donut and mechanically couples to said lower section.

Yet another aspect of the present invention is a sprinkler head serviceability apparatus comprising a plurality of ribs within said sprinkler head receiving cavity.

BRIEF DESCRIPTION OF THE DRAWING

For the purpose of initially illustrating the invention, the specification presents drawings, flow diagrams, and embodiments that are presently preferred as well as alternates. It should be understood, however, that the invention is not limited to the specific instrumentality and methods disclosed herein. It can be recognized that the figures represent a layout in which persons skilled in the art may make variations therein. In the drawings.

DETAILED DESCRIPTION OF THE DRAWING

Figure 1:
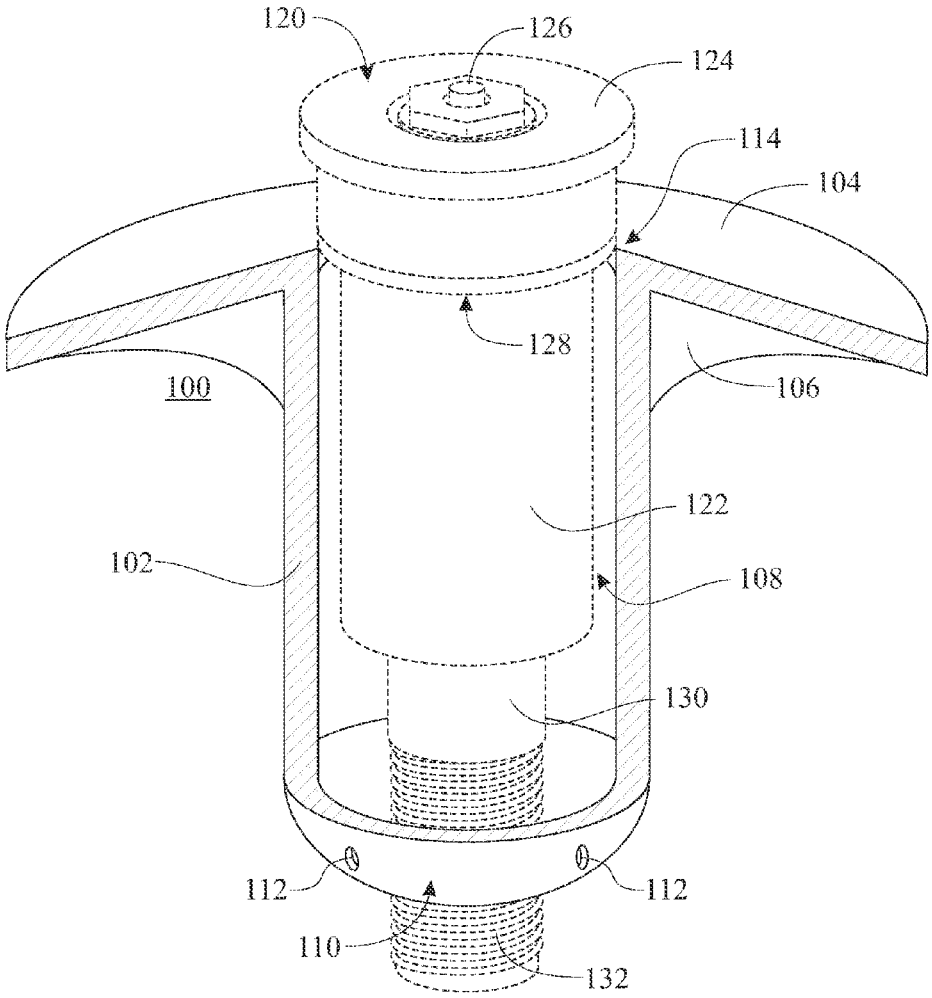
FIG. 1 illustrates an isometric view of a first embodiment of a sprinkler head serviceability enhancing apparatus as installed.

FIG. 1 illustrates an isometric view of a sprinkler serviceability enhancing apparatus 100 as installed about a sprinkler head assembly 120. Said sprinkler serviceability enhancing apparatus 100 comprising a sprinkler serviceability enhancing apparatus body 102, and sprinkler serviceability enhancing apparatus upper flange 104 and a sprinkler serviceability enhancing apparatus base section 110. Said sprinkler serviceability enhancing apparatus body 102 and sprinkler serviceability enhancing apparatus base section 110 create a sprinkler receiving cavity 108, wherein said sprinkler receiving cavity 108 provides a debris free cavity for receiving said sprinkler head assembly 120. A plurality of upper flange support rib(s) 106 can be incorporated as a means to stiffen said sprinkler serviceability enhancing apparatus upper flange 104. Several optional drainage apertures 112 can be incorporated into said sprinkler serviceability enhancing apparatus 100, providing a mechanism for draining any condensation that might accumulate within said sprinkler receiving cavity 108. It is recognized that said optional drainage apertures 112 could be incorporated into any of the presented embodiments of the present invention. Said sprinkler head assembly 120 comprising a sprinkler head base section 122, a sprinkler head 124 and a sprinkler head pipe coupling section 130. A sprinkler head water dispersion section 126 is coupled to a member of said sprinkler head assembly 120, usually said sprinkler head water dispersion section 126 is coupled to a riser (pop up) member (not shown, but well understood). Said sprinkler head assembly 120 is inserted through a sprinkler head access port 114 and coupled via a sprinkler pipe thread (s) 132 providing fluid communication to a sprinkler system plumbing. It is preferable that said sprinkler serviceability enhancing apparatus 100 is sealed against a sprinkler head bottom ridge 128 to ensure against debris entering said sprinkler receiving cavity 108. The sprinkler head access port 114 provides an opening about an upper edge of the sidewalls of the body 102. The sprinkler head access port 114 allows the service party to inert and remove the sprinkler head assembly 120 from the sprinkler serviceability enhancing apparatus 100, leaving an area open for reinstalling the sprinkler head assembly 120.

Figure 2:
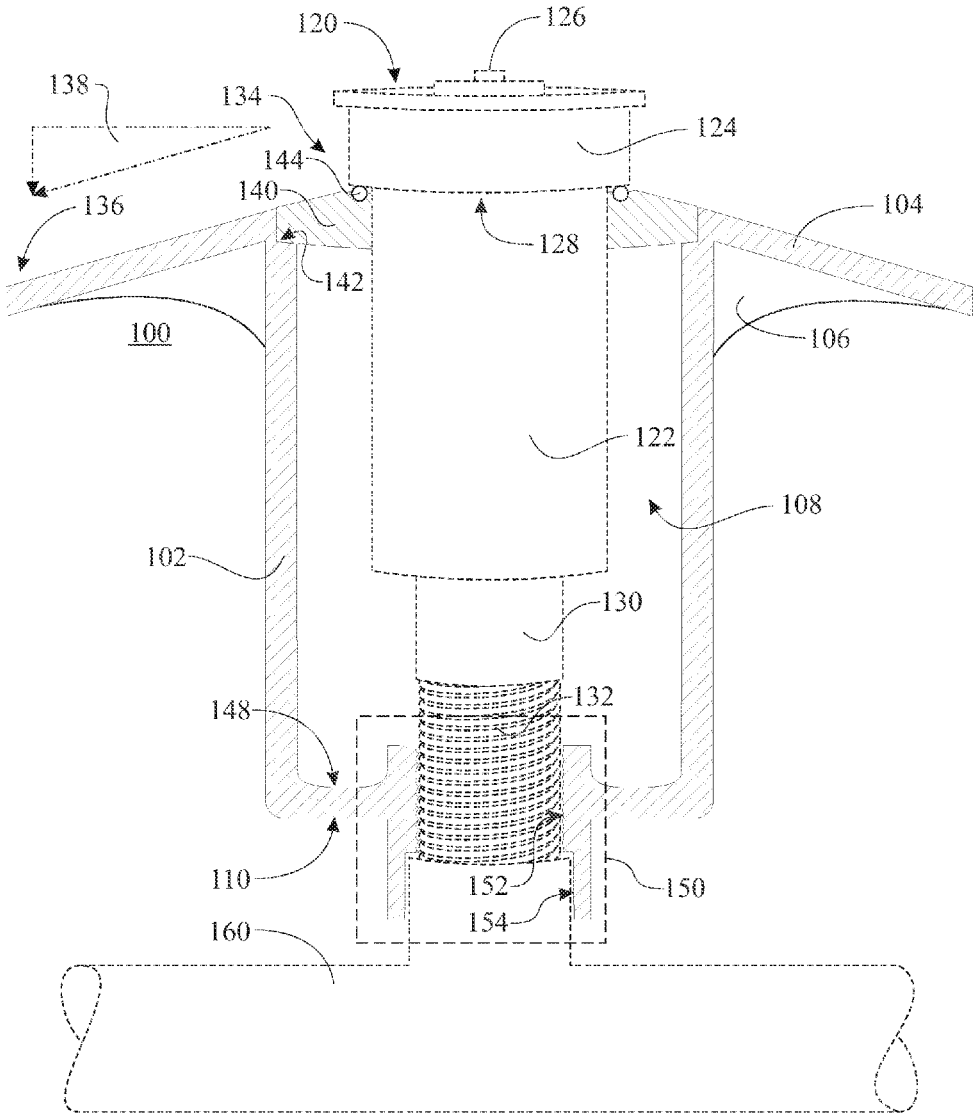
FIG. 2 illustrates an elevation, cross sectional view of a second embodiment of a sprinkler head serviceability enhancing apparatus as installed.

FIG. 2 illustrates a sectional, elevation view of said sprinkler serviceability enhancing apparatus 100. Said sprinkler serviceability enhancing apparatus upper flange 104 presents an upper flange downward slope 138, wherein said upper flange downward slope 138 is provided between an upper flange proxil region 134 and an upper flange distal region 136. Said upper flange downward slope 138 is at its highest position proximate said upper flange proxil region 134 and slopes downward in accordance with said upper flange downward slope 138 as said sprinkler serviceability enhancing apparatus upper flange 104 approaches said upper flange distal region 136. A sprinkler serviceability upper seal 140 is incorporated to provide a seal between said sprinkler serviceability enhancing apparatus upper flange 104 and said sprinkler head assembly 120. For manufacturability, said sprinkler serviceability upper seal 140 is provided as a separate member. A sprinkler serviceability upper seal gasket 144 is incorporated to provide an improved seal between said sprinkler head bottom ridge 128 and said sprinkler serviceability upper seal 140. It is recognized that alternates to said sprinkler serviceability upper seal gasket 144 can be utilized, including a molded lip, a collapsible flange, a gasket, and the like. Additionally, the illustration presents a sprinkler serviceability pipe coupling section 150, wherein said sprinkler serviceability pipe coupling section 150 comprising a female threaded section 152 for coupling said sprinkler head pipe coupling section 130 to a sprinkler plumbing 160, as well as a coupling section countersink 154 for providing clearance about a female section of the coupling as shown. A debris collection section 148 can be incorporated into the design of said sprinkler serviceability enhancing apparatus 100 to provide a gathering section for any debris or condensation that incidentally enters said sprinkler receiving cavity 108 of said sprinkler serviceability enhancing apparatus 100. Said sprinkler serviceability enhancing apparatus 100 would be fabricated in three sections: a general body section comprising said sprinkler serviceability enhancing apparatus body 102, sprinkler serviceability enhancing apparatus upper flange 104, and said sprinkler serviceability enhancing apparatus base section 110; said sprinkler serviceability upper seal 140; and said sprinkler serviceability upper seal gasket 144. Said general body section and said sprinkler serviceability upper seal gasket 144 would be preferably fabricated via injection-molded plastic. Said sprinkler serviceability upper seal gasket 144 would be fabricated respective to the selected means for creating the seal.

Figure 3:
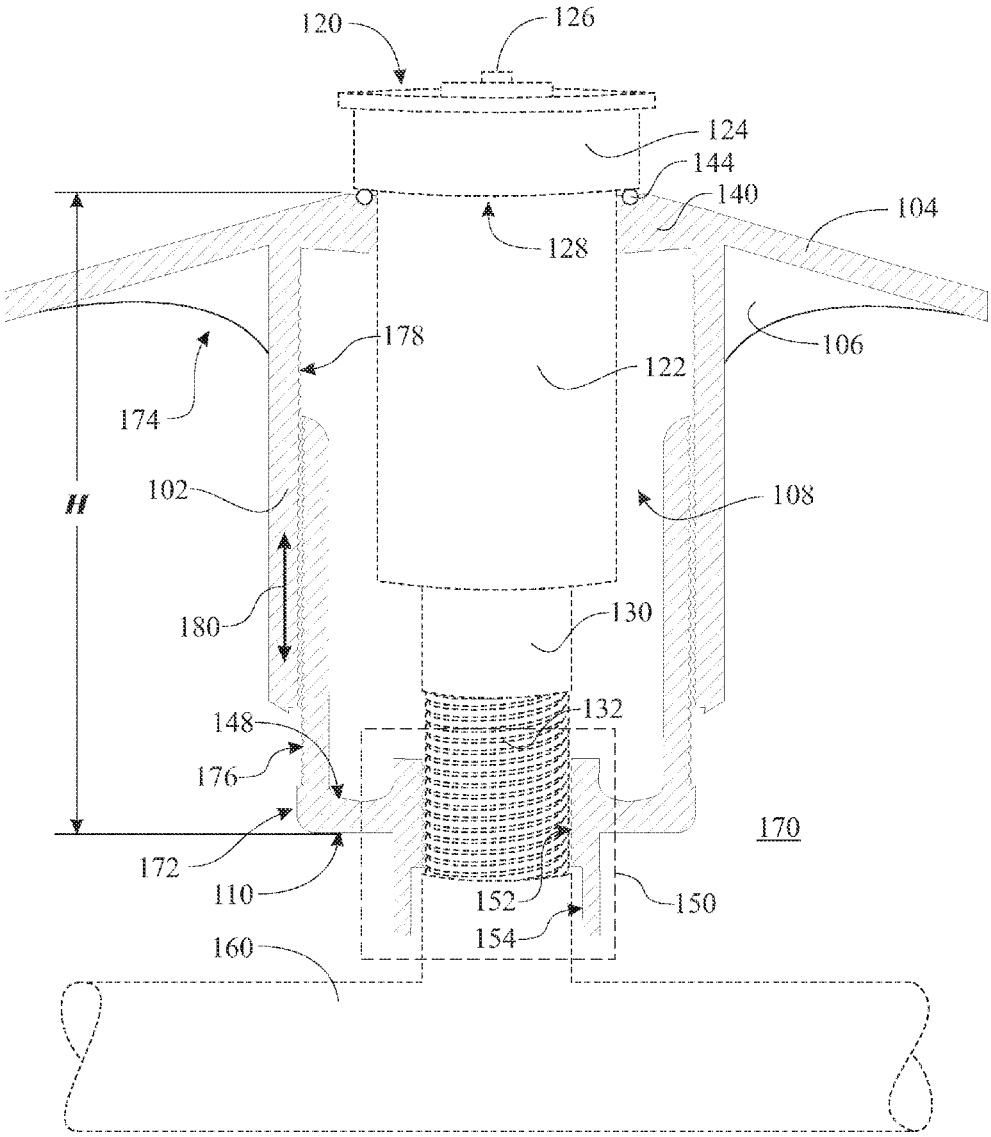
FIG. 3 illustrates an elevation, cross sectional view of a third embodiment of a sprinkler head serviceability enhancing apparatus, providing adjustable height.

FIG. 3 illustrates an adjustable sprinkler serviceability apparatus 170, wherein said adjustable sprinkler serviceability apparatus 170 is an embodiment of said sprinkler serviceability enhancing apparatus 100, said embodiment providing a means for adjusting a height (H) of said adjustable sprinkler serviceability apparatus 170. The illustration provides one representation of a means for adjusting a height (H) by fabricating said adjustable sprinkler serviceability apparatus 170 in two components: an adjustable sprinkler serviceability apparatus lower section 172 and an adjustable sprinkler serviceability apparatus upper section 174. Said adjustable sprinkler serviceability apparatus lower section 172 and said adjustable sprinkler serviceability apparatus upper section 174 are adjustably coupled to one another via any known adjustable means. Presented is one representative adjustable means providing a threaded interconnection; a base height adjustment thread 176 incorporated into said adjustable sprinkler serviceability apparatus lower section 172 and a top height adjustment thread 178 incorporated into said adjustable sprinkler serviceability apparatus upper section 174. As one rotates said adjustable sprinkler serviceability apparatus upper section 174 respective to said adjustable sprinkler serviceability apparatus lower section 172, said height (H) adjusts in accordance with a height adjustment 190. Said sprinkler serviceability upper seal 140 can be either integrated into said adjustable sprinkler serviceability apparatus upper section 174 as illustrated or integrated as a separate assembly as illustrated in FIG. 2 herein for ease of serviceability of said sprinkler head assembly 120. Alternately, a snap fit interconnection or other can be utilized to provide said height adjustment 190, wherein said snap fit interconnection can comprise a series of rings located on one section and respective recessions located on the opposing section.

Figure 4:
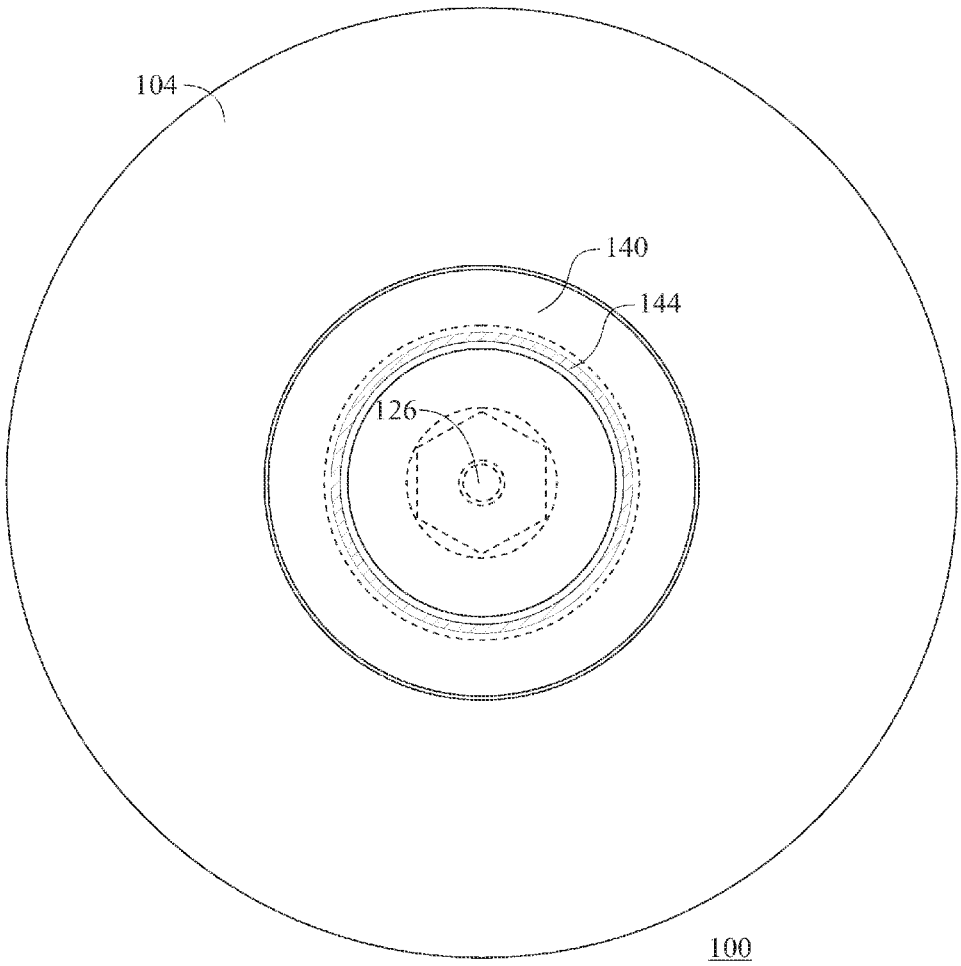
FIG. 4 illustrates a top view of a said sprinkler head serviceability enhancing apparatus more specifically incorporating the features of said second embodiment.

FIG. 4 illustrates a top view of said sprinkler serviceability enhancing apparatus 100, more specifically said sprinkler serviceability enhancing apparatus upper flange 104, said sprinkler serviceability upper seal 140, which resides within said sprinkler serviceability enhancing apparatus upper flange 104 and said sprinkler serviceability upper seal gasket 144 which resides within said sprinkler serviceability upper seal 140. Said sprinkler head water dispersion section 126 is included in phantom for reference purposes.

Figure 5:
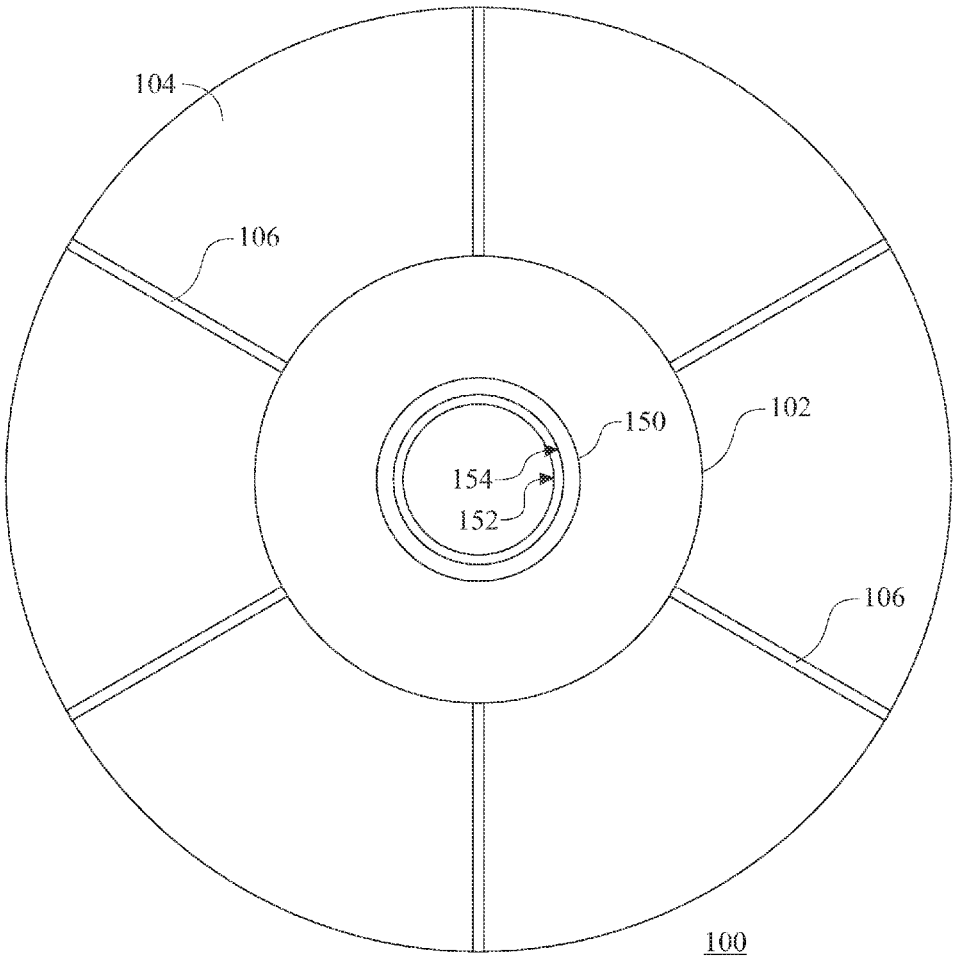
FIG. 5 illustrates a bottom view of a said sprinkler head serviceability enhancing apparatus.

FIG. 5 illustrates a bottom view of said sprinkler serviceability enhancing apparatus 100, more specifically said sprinkler serviceability enhancing apparatus upper flange 104, the outer edge of said sprinkler serviceability enhancing apparatus body 102, a plurality of said upper flange support rib(s) 106 and said sprinkler serviceability pipe coupling section 150. Said sprinkler serviceability pipe coupling section 150 comprising said female threaded section 152 and said coupling section countersink 154.

Figure 6:
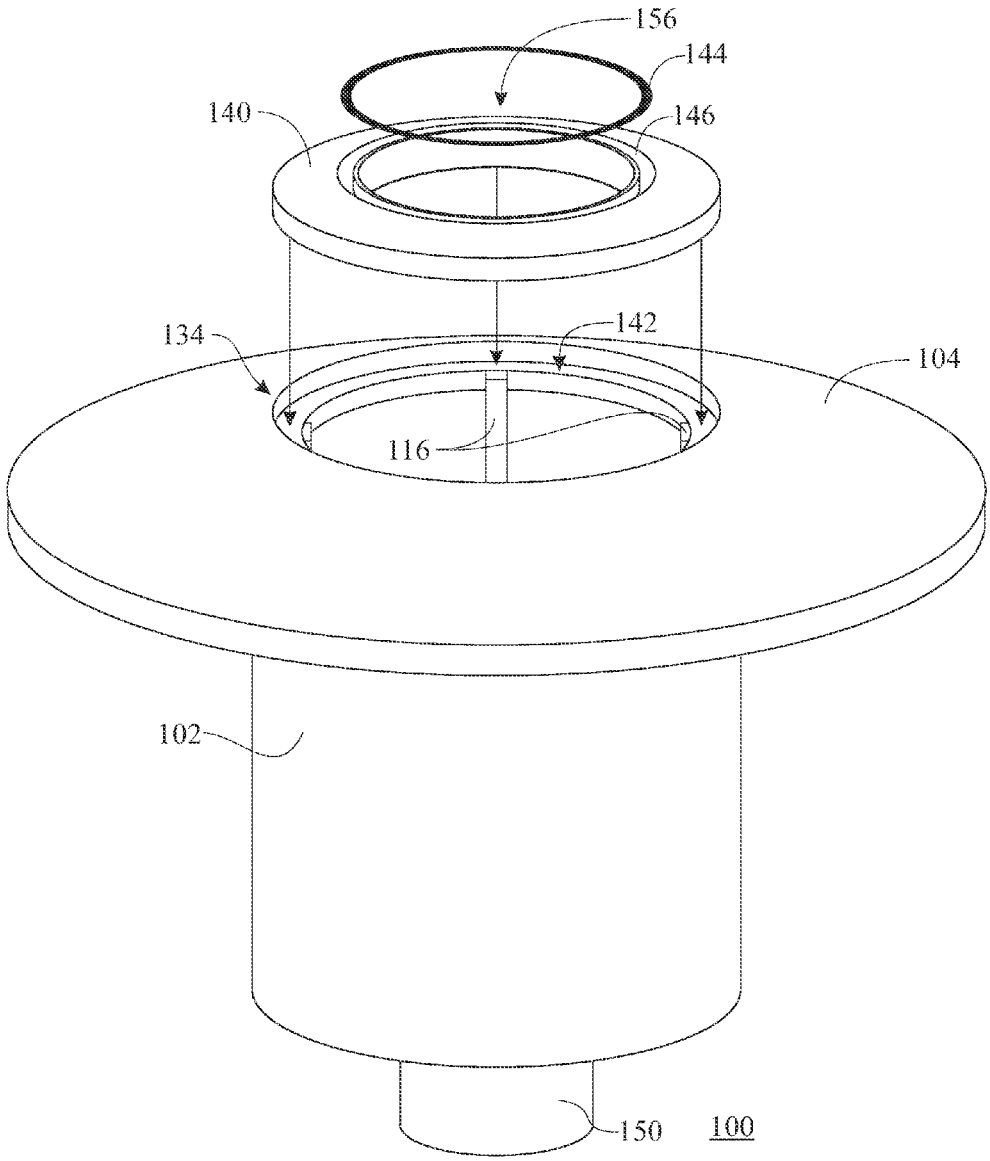
FIG. 6 illustrates an isometric view of a second embodiment of a sprinkler head serviceability enhancing apparatus as an assembly drawing.

FIG. 6 illustrates an isometric view presenting an assembly drawing of said sprinkler serviceability enhancing apparatus 100. Said sprinkler serviceability enhancing apparatus 100 comprising a base section (comprising said sprinkler serviceability enhancing apparatus body 102, said sprinkler serviceability enhancing apparatus upper flange 104, and said sprinkler serviceability pipe coupling section 150), said sprinkler serviceability upper seal 140, and said sprinkler serviceability upper seal gasket 144. Said sprinkler serviceability upper seal gasket 144 is assembled into a sprinkler serviceability upper seal gasket recess 146 located within said sprinkler serviceability upper seal 140. A sprinkler head access port 156 is provided through the sprinkler serviceability upper seal 140, wherein the sprinkler head assembly 120 can be inserted therethrough. Said sprinkler serviceability upper seal 140 is assembled into a sprinkler serviceability upper seal coupling section 142 proximate said upper flange proxil region 134 of said sprinkler serviceability enhancing apparatus upper flange 104 of said base section. Said sprinkler serviceability upper seal 140 can be coupled within said sprinkler serviceability upper seal coupling section 142 via any known method, including simply placing said sprinkler serviceability upper seal 140 inside said sprinkler serviceability upper seal coupling section 142, screwing said sprinkler serviceability upper seal 140 into said sprinkler serviceability upper seal coupling section 142, snap fit between said sprinkler serviceability upper seal 140 and said sprinkler serviceability upper seal coupling section 142, adhesively coupling said sprinkler serviceability upper seal 140 into said sprinkler serviceability upper seal coupling section 142, and the like. Optionally, a plurality of sprinkler head support ribs 116 can be incorporated within said sprinkler receiving cavity 108, wherein said plurality of sprinkler head support ribs 116 have several benefits. One such benefit aligns said sprinkler head assembly 120 to said sprinkler serviceability upper seal coupling section 142. A second such benefit provides support to said sprinkler head assembly 120. A third such benefit provides vertical strengthening to said sprinkler receiving cavity 108.

Figure 7:
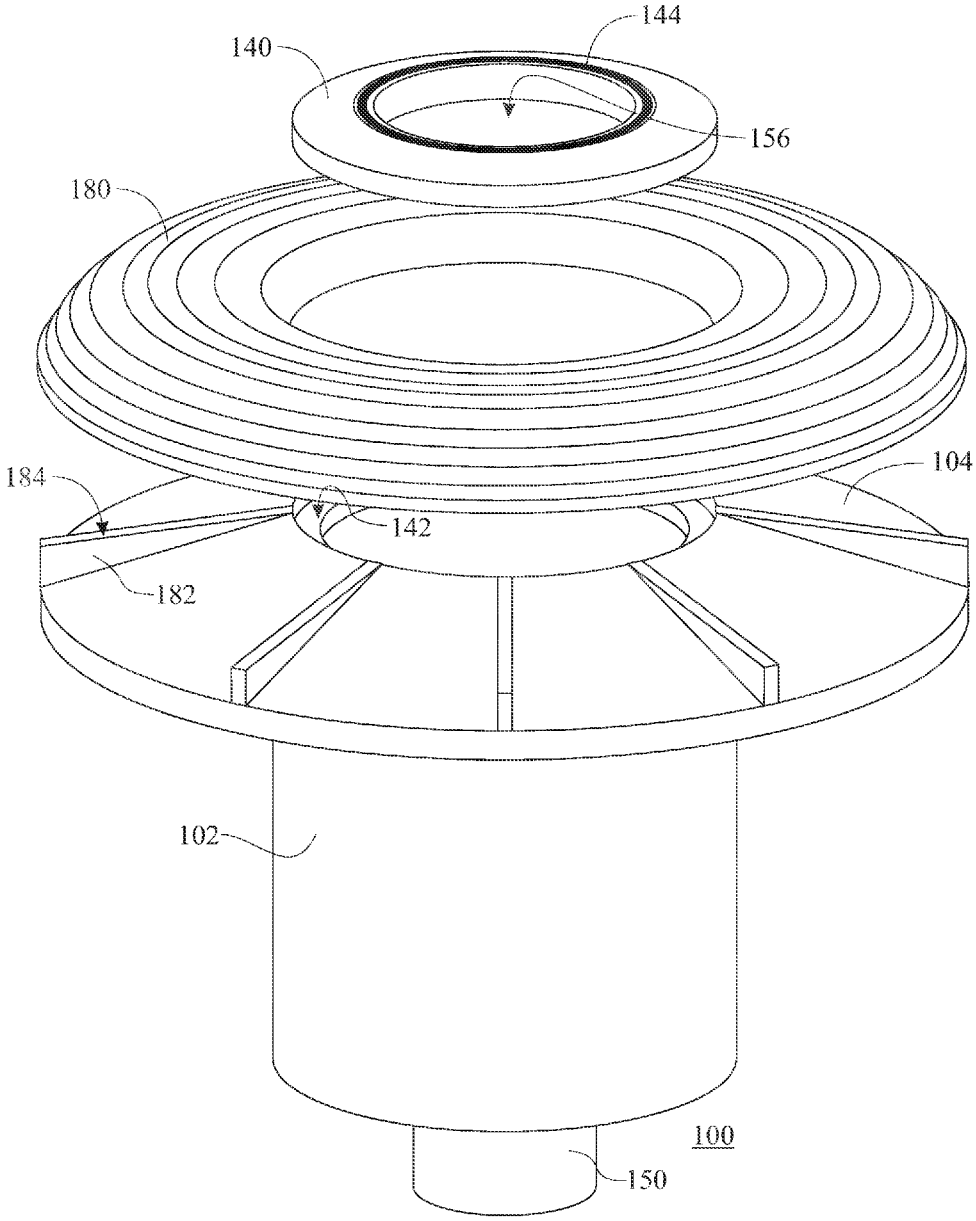
FIG. 7 illustrates an isometric view of a fourth embodiment of a sprinkler head serviceability enhancing apparatus introducing a common donut supporting member.

FIG. 7 illustrates an optional feature for said sprinkler serviceability enhancing apparatus 100, providing a means for protection in addition to serviceability of said sprinkler head assembly 120 (not shown). It is recognized that the present invention can combine the features taught in FIG. 7 with all of the embodiments presented herein. Said optional feature provides a section located above said sprinkler serviceability enhancing apparatus upper flange 104 which is planar or above said sprinkler head 124 of said sprinkler head assembly 120. One such option comprising a plurality of donut support member(s) 182, wherein said donut support member(s) 182 comprising a donut support contacting surface 184 which provides support for a common sprinkler donut 180. The common sprinkler donut 180 is an exemplary form factor of a sprinkler head protection apparatus. A center of said common sprinkler donut 180 can be sized such to reside on top of said sprinkler serviceability upper seal 140 or sufficient that said sprinkler serviceability upper seal 140 can pass through said center of said common sprinkler donut 180. The assembly process would be respective to said dimensions. Alternately, said common sprinkler donut 180 can be fabricated of a moldable material capable of supporting a load and protecting said sprinkler head assembly 120 from damage. The molded version of said common sprinkler donut 180 would couple to said sprinkler serviceability enhancing apparatus upper flange 104. Any of the presented versions would include a passage allowing any debris to be washed down said sprinkler serviceability enhancing apparatus upper flange 104. The donut support member(s) 182 would be of a sufficient size to provide clearance between the bottom of said common sprinkler donut 180 and the upper surface of said sprinkler serviceability enhancing apparatus upper flange 104. The molded version of said common sprinkler donut 180 would comprise channels or clearances (not shown but well understood by those skilled in the art) allowing any debris to be removed via fluid flow such as sprinkler water or rain water.

Figure 8:
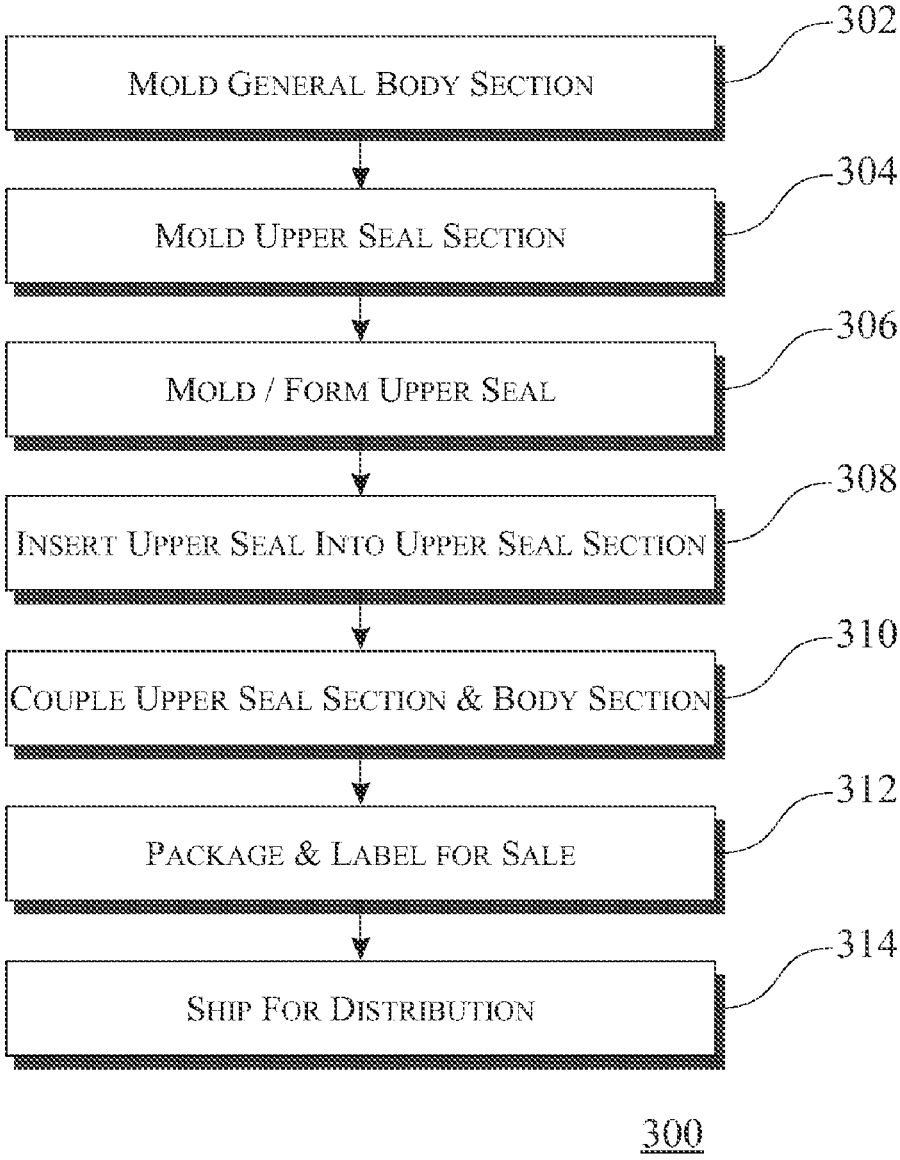
FIG. 8 illustrates a flow diagram representative of a manufacturing process for said sprinkler head serviceability enhancing apparatus.

FIG. 8 illustrates a sprinkler head serviceability apparatus fabrication flow diagram 300 representative of a fabrication process of the present invention. Said sprinkler head serviceability apparatus fabrication flow diagram 300 initiates with a series of molding steps to fabricate the sections of the present invention, including a molding of said general body section step 302, a molding of said upper seal section step 304, and a molding or forming step of said upper seal step 306. It is understood that the components can be fabricated via other means while maintaining the spirit and intent of the present invention. The upper seal is inserted into said upper seal coupling section in accordance with an upper seal insertion/assembly step 308. The completed upper seal section is then coupled to said general body section in accordance with a coupling upper seal section to said general body section step 310. The finished assembly is then packaged and labeled for sale in accordance with a package and label for sale step 312. The packaged units are bulk packed and shipped for distribution in accordance with a ship for distribution step 314.

The Applicants have provided a method and apparatus, with several options, for creating and using said sprinkler head serviceability apparatus. Although the apparatus and methods taught herein are the preferred and alternate embodiments, it can be recognized that other form factors, materials, and methods of achieving the same results can be contrived from the disclosed teachings.

What is claimed is:

1. A sprinkler serviceability enhancing apparatus, said sprinkler serviceability enhancing apparatus comprising: a sprinkler head receiving cavity comprising a side wall, a base section, and a sprinkler head access port wherein said sprinkler head receiving cavity encompasses a side and base independent of a separate sprinkler head assembly; wherein said sprinkler head assembly comprises a sprinkler head having a sprinkler head bottom ridge along a lower portion of the sprinkler head, a sprinkler head base section, and a sprinkler head coupling section; a sprinkler head upper seal and a sprinkler head upper seal gasket providing a seat dam between a said sprinkler head bottom ridge and said sprinkler head receiving cavity, wherein the sprinkler head bottom ridge in contiguous communication with the gasket, the gasket is in contiguous communication with the sprinkler head upper seal, and the sprinkler head upper seal is in contiguous communication with the sprinkler head receiving cavity creating a dam between the sprinkler head bottom ridge and said sprinkler head receiving cavity to ensure against unwanted debris to collect within the sprinkler head receiving cavity, thus allowing a worker to remove the sprinkler head assembly from the sprinkler head receiving cavity and wherein the sprinkler head receiving cavity maintains a clearance for working therein; wherein at an upper seal coupling section, the sprinkler head upper seal mates with an upper flanged section which projects outwardly from said sprinkler head receiving cavity; and wherein said upper flanged section projects from a upper flange proxil region to an upper flange distal region, and said upper flanged section generally sloping downward from said upper flange proxil region towards said upper flange distal region, while the sprinkler head upper seal has a corresponding slope to that of the upper flanged section.

2. The sprinkler serviceability enhancing apparatus of claim 1, said sprinkler serviceability enhancing apparatus further comprising a threaded pipe coupling section located as a base of said sprinkler serviceability enhancing apparatus.

3. The sprinkler serviceability enhancing apparatus of claim 2, said sprinkler serviceability enhancing apparatus further comprising a coupling section countersink located proximate said threaded pipe coupling section.

4. The sprinkler serviceability enhancing apparatus of claim 1, wherein said sprinkler head upper seal is removably coupled to said sprinkler serviceability enhancing apparatus.

5. The sprinkler serviceability enhancing apparatus of claim 1, wherein said seal gasket is at least one of an o-ring and a flexible seal.

6. The sprinkler serviceability enhancing apparatus of claim 1, further comprising at least one common sprinkler donut supporting member, wherein said at least one common sprinkler donut supporting member projecting from said upper flanged section, wherein said at least one common sprinkler donut supporting member provides a planar surface for supporting a common sprinkler donut.

7. The sprinkler serviceability enhancing apparatus of claim 1, further comprising a sprinkler head protection member, wherein said sprinkler head protection member resides above said upper flanged section and projects above said sprinkler head to protect said sprinkler head.

8. A sprinkler serviceability enhancing apparatus, said sprinkler serviceability enhancing apparatus comprising: a sprinkler head receiving cavity comprising a side wall, a base section, and a sprinkler head access port wherein said sprinkler head receiving cavity encompasses a side and base independent of a separate sprinkler head assembly; wherein said sprinkler head assembly comprises a sprinkler head having a sprinkler head bottom ridge along a lower portion of the sprinkler head, a sprinkler head base section, and a sprinkler head coupling section; a sprinkler head upper seal and a sprinkler head upper seal gasket providing a seal dam between a said sprinkler head bottom ridge and said sprinkler head receiving cavity, wherein the sprinkler head bottom ridge in contiguous communication with the gasket, the gasket is in contiguous communication with the sprinkler head upper seal, and the sprinkler head upper seal is in contiguous communication with the sprinkler head receiving cavity creating a dam between the sprinkler head bottom ridge and said sprinkler head receiving cavity to ensure against unwanted debris to collect within the sprinkler head receiving cavity, thus allowing a worker to remove the sprinkler head assembly from the sprinkler head receiving cavity and wherein the sprinkler head receiving cavity maintains a clearance for working therein; wherein at an upper seal coupling section, the sprinkler head upper seal mates with an upper flanged section which projects outwardly from said sprinkler head receiving cavity; an upper section of said sprinkler serviceability enhancing apparatus and a separate lower section of said sprinkler serviceability enhancing apparatus, wherein said upper section of said sprinkler serviceability enhancing apparatus and said separate lower section of said sprinkler serviceability enhancing apparatus are adjustably coupled in a manner to adjust an overall height of said sprinkler serviceability enhancing apparatus; and wherein said upper flanged section projects from a upper flange proxil region to an upper flange distal region, and said upper flanged section generally sloping downward from said upper flange proxil region towards said upper flange distal region, while the sprinkler head upper seal has a corresponding slope to that of the upper flanged section.

9. The sprinkler serviceability enhancing apparatus of claim 8, wherein said adjustable coupling between said upper section of said sprinkler serviceability enhancing apparatus and said separate lower section of said sprinkler comprising a threaded section.

10. The sprinkler serviceability enhancing apparatus of claim 8, wherein said adjustable coupling between said upper section of said sprinkler serviceability enhancing apparatus and said separate lower section of said sprinkler comprising a snap fit connection interface section.

11. The sprinkler serviceability enhancing apparatus of claim 8, said sprinkler serviceability enhancing apparatus further comprising a threaded pipe coupling section located as a base of said sprinkler serviceability enhancing apparatus.

12. The sprinkler serviceability enhancing apparatus of claim 8, wherein said sprinkler head upper seal is removably coupled to said upper section of said sprinkler serviceability enhancing apparatus.

13. The sprinkler serviceability enhancing apparatus of claim 8, wherein said seal gasket is at least one of an o-ring and a flexible seal.

14. The sprinkler serviceability enhancing apparatus of claim 8, further comprising at least one common sprinkler donut supporting member, wherein said at least one common sprinkler donut supporting member projecting from said upper flanged section, wherein said at least one common sprinkler donut supporting member provides a planar surface for supporting a common sprinkler donut.

15. A sprinkler serviceability enhancing apparatus, said sprinkler serviceability enhancing apparatus comprising: a sprinkler head receiving cavity comprising a side wall, a base section, and a sprinkler head access port wherein said sprinkler head receiving cavity encompasses a side and base independent of a separate sprinkler head assembly; wherein said sprinkler head assembly comprises a sprinkler head having a sprinkler head bottom ridge along a lower portion of the sprinkler head, a sprinkler head base section, and a sprinkler head coupling section; an upper flanged section projecting outward from said sprinkler head receiving cavity; wherein said upper flanged section projects from a upper flange proxil region to an upper flange distal region, and said upper flanged section generally sloping downward from said upper flange proxil region towards said upper flange distal region; and a sprinkler head upper seal comprising a seal gasket disposed thereon, between a sprinkler head bottom ridge and said sprinkler head receiving cavity, wherein said seal gasket projects upward from said sprinkler head upper seal and said sprinkler head upper seal is located proximate said upper flange proxil region of said upper flanged section, wherein the sprinkler head bottom ridge in contiguous communication with the gasket, the gasket is in contiguous communication with the sprinkler head upper seal, and the sprinkler head upper seal is in contiguous communication with the sprinkler head receiving cavity creating a dam between the sprinkler head bottom ridge and said sprinkler head receiving cavity to ensure against unwanted debris to collect within the sprinkler head receiving cavity, thus allowing a worker to remove the sprinkler head assembly from the sprinkler head receiving cavity and wherein the sprinkler head receiving cavity maintains a clearance for working therein, wherein at an upper seal coupling section, the sprinkler head upper seal mates with said upper flanged section and said sprinkler head upper seal has a corresponding slope to that of said upper flanged section.

16. The sprinkler serviceability enhancing apparatus of claim 15, said sprinkler serviceability enhancing apparatus further comprising a threaded pipe coupling section located as a base of said sprinkler serviceability enhancing apparatus.

17. The sprinkler serviceability enhancing apparatus of claim 15, wherein said sprinkler head upper seal is removably coupled to said sprinkler serviceability enhancing apparatus.

18. The sprinkler serviceability enhancing apparatus of claim 15, wherein said seal gasket is at least one of an o-ring and a flexible seal.

19. The sprinkler serviceability enhancing apparatus of claim 15, further comprising at least one common sprinkler donut supporting member, wherein said at least one common sprinkler donut supporting member projecting from said upper flanged section, wherein said at least one common sprinkler donut supporting member provides a planar surface for supporting a common sprinkler donut.

20. The sprinkler serviceability enhancing apparatus of claim 15, further comprising a sprinkler head protection member, wherein said sprinkler head protection member resides above said upper flanged section and projects above said sprinkler head to protect said sprinkler head.

* * * * *